United States Patent [19]

Röck et al.

[11] Patent Number: 4,815,798

[45] Date of Patent: Mar. 28, 1989

[54] HOLDING DEVICE FOR THE FRONT PLATE OF A DRAWER

[75] Inventors: Erich Röck, Höchst; Helmut Hollenstein, Lustenau; Josef Brunner, Höchst, all of Austria

[73] Assignee: Julius Blum Gesellschaft m.b.H., Höchst, Austria

[21] Appl. No.: 37,251

[22] Filed: Apr. 10, 1987

[30] Foreign Application Priority Data

May 28, 1986 [AT] Austria ..... 1437/86

[51] Int. Cl.[4] ..... A47B 88/00

[52] U.S. Cl. ..... 312/330 R; 312/263

[58] Field of Search ..... 312/330 R, 263; 403/297, 249, 362

[56] References Cited

U.S. PATENT DOCUMENTS 4,595,245 6/1986 Rock et al. ..... 312/330 R 4,609,236 9/1986 Twellmann ..... 312/330 R

*Primary Examiner*—Joseph Falk

*Attorney, Agent, or Firm*—Wenderoth, Lind & Ponack

[57] ABSTRACT

A holding device for the front plate of a drawer with metal drawer frames includes holding members fastened to the front plate and supporting members fastened respective of the drawer frames. The holding members are engageable in the supporting members. The supporting members are adjustably fastened to the drawer frames by means of clamping screws.

15 Claims, 4 Drawing Sheets

HOLDING DEVICE FOR THE FRONT PLATE OF A DRAWER

The invention relates to a holding device for mounting the front plates of a drawer on metal drawer frames, and including, on each side of the drawer, a holding member associated with the front plate and a supporting member associated with the drawer frame, the holding member and the supporting member being engageable with and fixable to each other.

In addition to drawers which are an integral piece, in particular drawers of plastics material, drawers which consist of several parts are still frequently used.

Such drawers are in most cases provided with fittings which are part of a pull-out guide assembly and facilitate extraction from and insertion of the drawer into a body of the piece of furniture.

Modern drawers further have a holding means for the front plate which allows an adjustment of the position of the front plate after mounting thereof to be able to correct the alignment thereof relative to the drawer which has been inserted into the body of the piece of furniture, with respect to the joints and to the side of the piece of furniture.

Furthermore, drawers are known which have metal drawer frames, i.e. side walls. Such drawer frames have the advantage that the pull-out rails of the pull-out guide assembly can be formed directly to as part of the frames.

SUMMARY OF THE INVENTION

It is the object of the invention to provide a holding device for a front plate which will allow simple and quick fastening of the front plate to metal drawer frames of the afore-mentioned kind, providing at the same time the possibility of later vertical and lateral adjustments of the relative position of the front plate.

According to the invention this is achieved in that the supporting members are adjustably fastened to the drawer frames by means of clamping screws.

It is advantageously provided that the supporting members are provided with height adjusting screws or eccentrics on which the holding members abut, or that the drawer frames are provided with height adjusting screws or eccentrics on which the supporting members abut.

By means of the height adjusting screw or the eccentric it is possible to preset a zero-position for the height adjustment of the front plate. Thus, mounting of the front plates of several drawers is substantially accelerated, because no particular height adjustment is generally required. The front plate need only be engaged in the supporting members and fixed thereto. Only if a height adjustment is absolutely necessary such adjustment can be effected by turning the eccentric or the height adjusting screw.

A particularly quick locking of the front plate to the drawer frames is obtained when the holding members and the supporting members are linked to one another by snapping means. In this arrangement the holding members may be provided with resilient flap members which engage in openings of the supporting members, the supporting members being provided with counterbearings.

An embodiment of the invention provides that the holding members have at their tops horizontal covers or flanges for the supporting members.

Such cover not only prevents the entering of dust into the holding device, but at the same time may form a stop for the holding member.

Another embodiment of the invention provides that the drawer frames have flanges which are angled parallel to the front plate and to which the supporting members can be clamped, the supporting members being preferably S-shaped when viewed from the top.

A further embodiment of the invention provides that clamping screws are mounted in base members which are preferably punched out of the drawer frames and each of which has an inclined face on which abuts a corresponding inclined face of the respective supporting member, so that the supporting members are pulled to the drawer frames when the clamping screws are fastened.

Another embodiment of the invention provides that the drawer frames are provided with angular slots which are forwardly open and in which the clamping screws which are mounted on the supporting members can be engaged.

An advantageous way of locking the holding members to the supporting members is obtained by providing the supporting members with recesses having undercuts, for example T-shaped recesses, into which corresponding projections of the holding members are insertable, the holding members being preferably laterally insertable into the supporting members. The holding members then are clamped by means of eccentrics.

BRIEF DESCRIPTION OF THE DRAWINGS

Various embodiments of the invention will now be described in detail with reference to the accompanying drawings in which.

Figure 1:
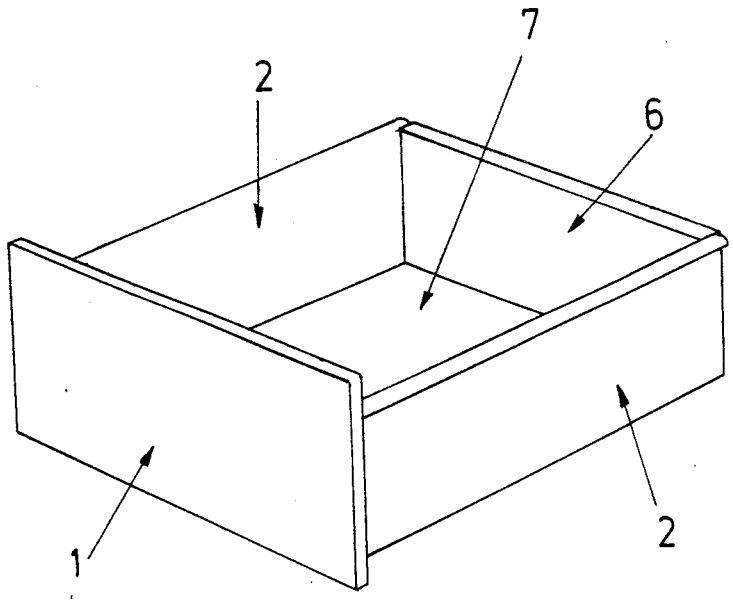
FIG. 1 is a schematic perspective view of a drawer.
Figure 2:
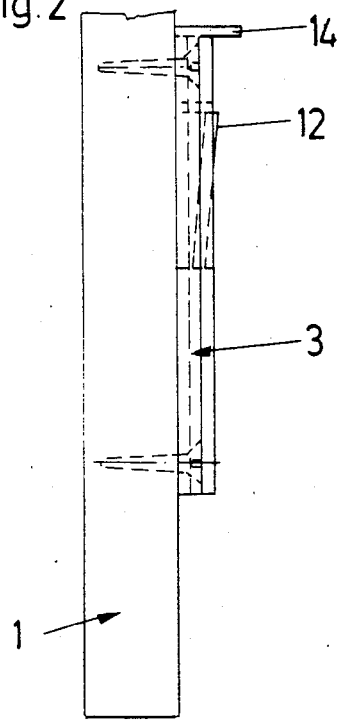
FIG. 2 is a side view of a front plate with a holding member.
Figure 3:
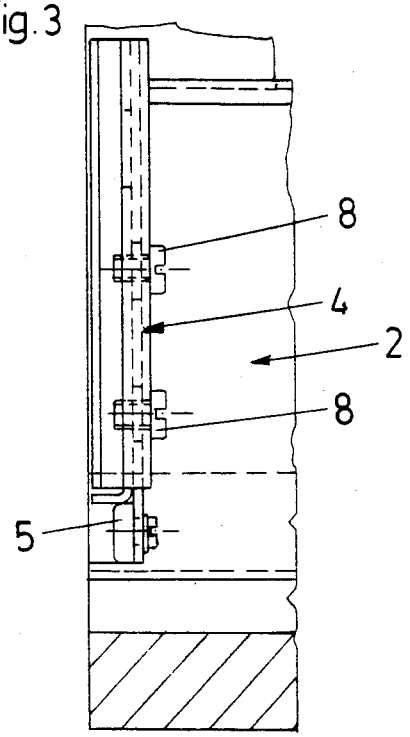
FIG. 3 is a side view, partially in section, of the front end of a drawer frame with a supporting member.
Figure 4:
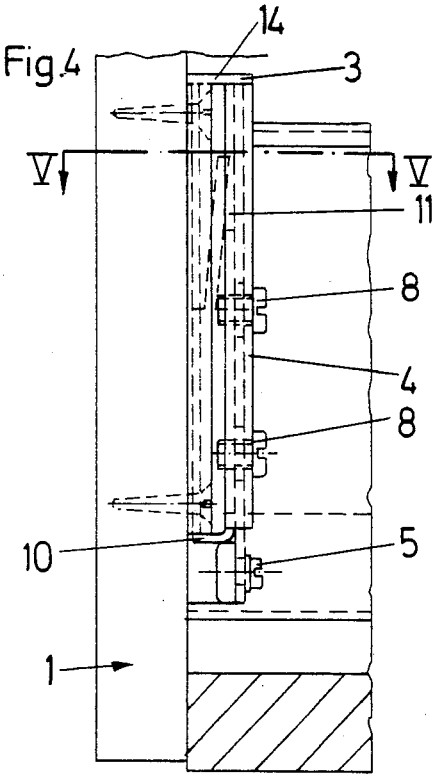
FIG. 4 is a side view of the front plate fastened to the drawer frame.
Figure 5:
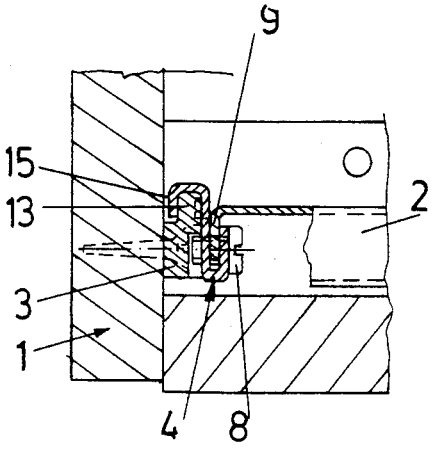
FIG. 5 is a sectional view along line V—V of FIG. 4, and FIGS. 6 to 13 are views analogous to FIGS. 2 to 5, but of two further embodiments of the invention.
Figure 6:
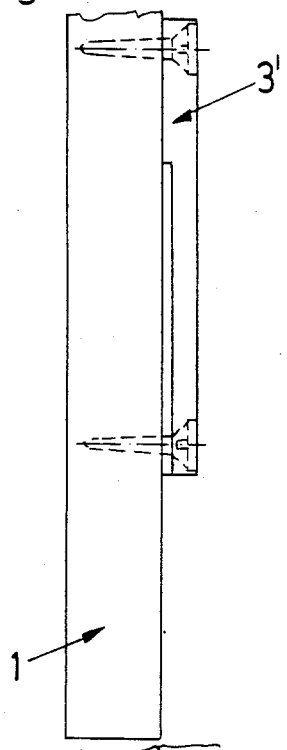
Figure 7:
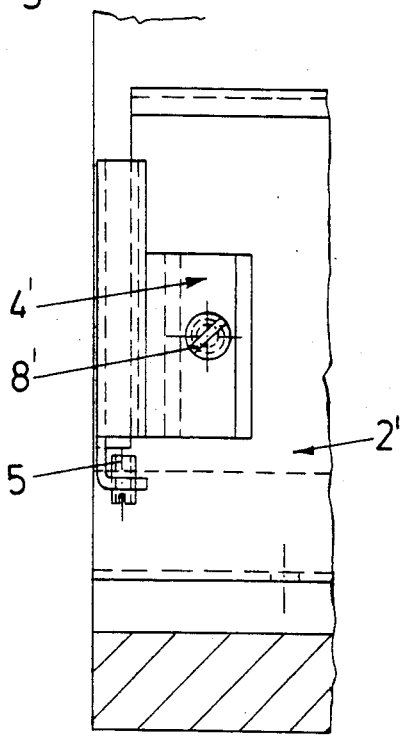
Figure 8:
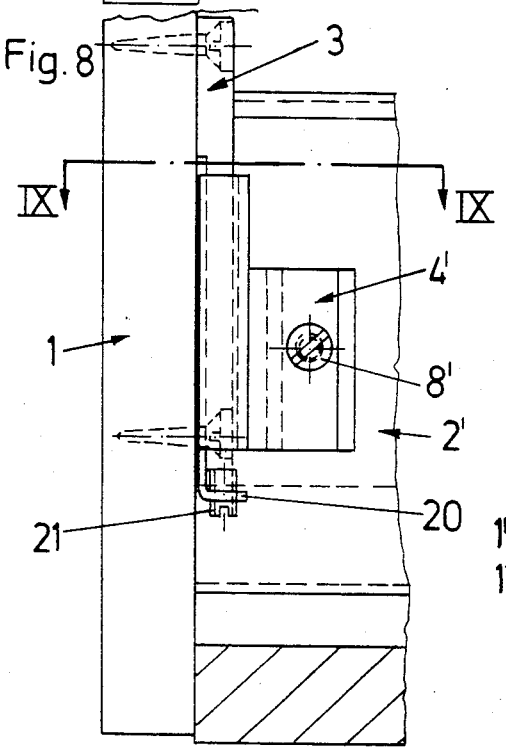

In the drawings the holding device is shown at one side only of the front plate, and the other side is obviously designed in the same manner.

DESCRIPTION OF THE PREFERRED EMBODIMENTS

The essential parts of a drawer are a front plate 1, two metal drawer frames 2, a rear wall 6 and a drawer bottom 7.

The front plate 1 is provided with two holding members 3 which are fastened to the front plate by means of screws for example.

At the front end of each drawer frame 2 is attached a supporting member 4 by means of one or several clamping screws 8.

In the following an embodiment according to FIGS. 2 to 5 will be described.

The supporting member 4, which is S-shaped when viewed from the top, is held by means of clamping screw 8 on a base member in the form of a flange 9 of the drawer frame which is aligned parallel to the front plate 1.

An eccentric 5 is mounted at the lower side of the drawer frame. The supporting member has a stop 10 which abuts on the eccentric 5. A zero position in the vertical alignment of the supporting member 4, and hence of the front plate 1 which is then engaged therewith, as well as vertical adjustment of such members are possible by means of eccentric 5.

The supporting member 4 has an opening 11. The holding member 3 is provided with a resilient flap 12.

When the holding member 3, which has a flange 13 extending laterally into a laterally open and vertically extending U-shaped channel formed by part of the S-shape of supporting member 4, is inserted into the supporting member from above, the resilient flap 12 engages in the opening 11. The holding member 3 is thus fixed in the supporting member 4.

A counterstop to the resilient flap 12 may be formed either by an upper horizontal cover 14 of holding member 3 or by the stop 10.

Lateral adjustment of the front plate 1 is possible through a clearance between the flange 13 of the holding member 3 and a flange 15 of the supporting member 4.

In the following an embodiment according to FIGS. 6 to 9 will be described in more detail.

Figure 9:
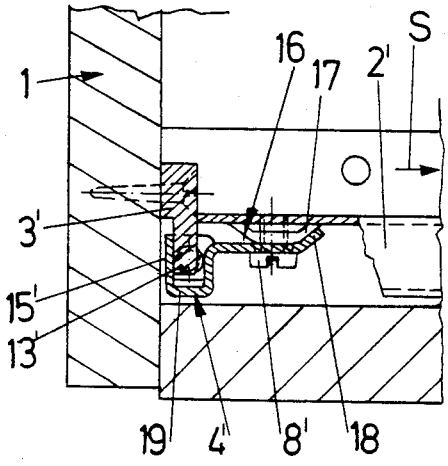
Figure 10:
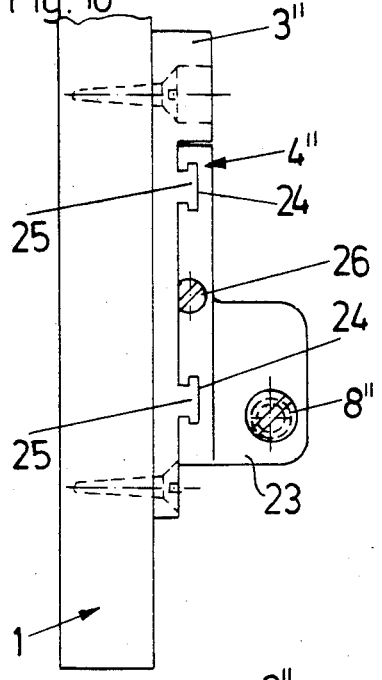
Figure 11:
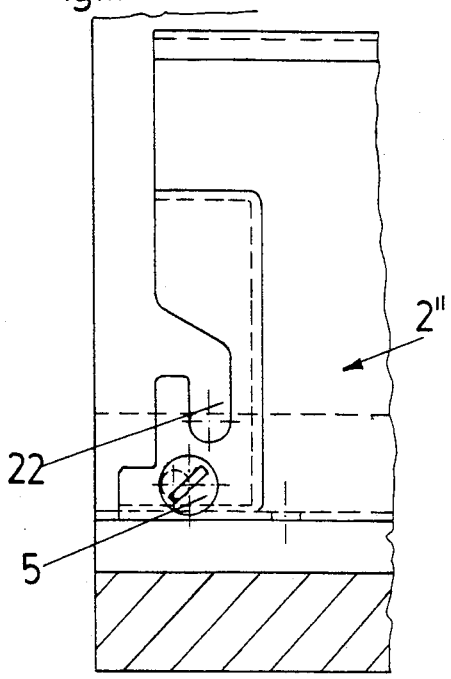
Figure 12:
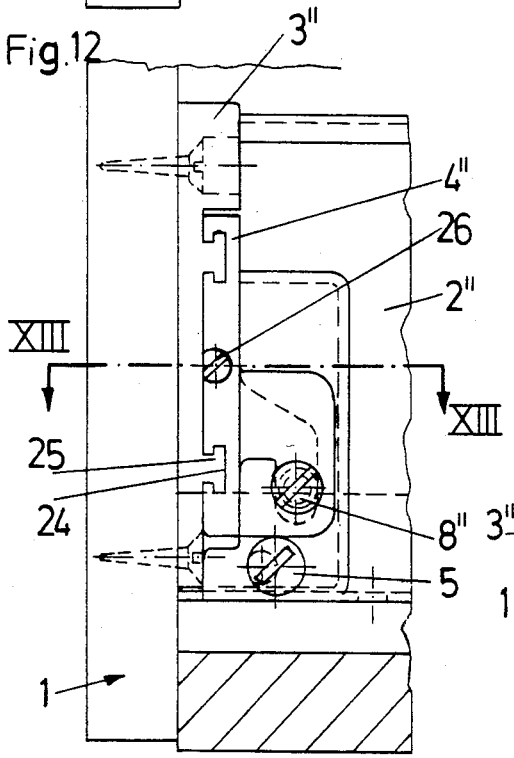
Figure 13:
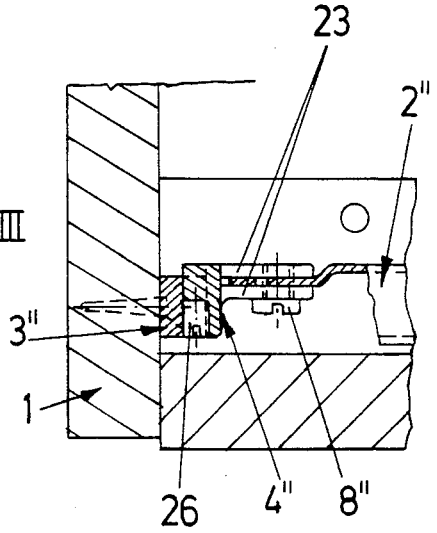

As can particularly be seen from FIG. 9, a drawer frame 2' is provided with a punched base member 16 having an inclined surface 17 at an end thereof opposite the front plate 1.

A supporting member 4' is provided with a flap 18 which has an inclined surface corresponding to the inclined surface 17. A clamping screw 8' is mounted in the base member 16.

The supporting member 4' has a U-shaped bracket member 19 with a flange 15' parallel to the front plate 1. A flange 13 of a holding member 3 is insertable into said flange 15 from above. When the clamping screw 8' is fastened, the supporting member 4' is pulled in the direction of arrow S because of the inclined surface 17 of base member 16 and the corresponding inclined surface of the flap 18, and the holding member 3' is pressed against the front edge of the drawer frame 2'. The front plate 1 is thus fixed.

A flap 20 is arranged at the lower side of the supporting member 4', and has a female thread into which a height adjusting screw 21 is threaded. The holding member 3' which is inserted into the supporting member 4' abuts on height adjusting screw 21.

Height adjusting screw 21 also allows for zero-positioning and for height adjustment of the front plate 1.

Lateral adjustment of the front plate 1 is effected by displacing the flange 13' of the holding member 3' relative to the flange 15' of the supporting member 4'.

In the following an embodiment according to FIGS. 10 to 13 will be described in more detail.

In this embodiment a drawer frame 2'' is provided at its front with an open annular slot 22. A clamping screw 8'' is engageable in and is mounted in two flanges 23 of a supporting member 4'', flanges 23 receiving therebetween the drawer frame 2'' when the supporting member 4'' is engaged in the drawer frame 2''.

An eccentric 5'' is arranged at the lower side of the drawer frame, namely essentially below slot 22. When being engaged in the drawer frame 2'', flanges 23 of the supporting member 4'' abut on the eccentric 5'', thus providing zero-positioning and the possibility of vertically adjusting the front plate 1 by turning eccentric 5''.

The clamping screw 8'' has simply to be fastened to fix the supporting member 4'' to the front plate.

The supporting member has horizontal T-shaped recesses 24 into which corresponding horizontal projections 25 of a holding member 3'' are insertable. Projections 25 and the recesses 24 allow relative lateral adjustment of the front plate 1. When the front plate is in the correct position, an eccentric 26, mounted in supporting member 4'' and engageable with holding member 3'', is fastened.

What is claimed is:

1. A fastening device for connecting a front plate of a drawer to metal side frames of the drawer, each side frame being formed by a single thickness of metal sheet material, said fastening device comprising, for each side of the drawer:

a holding member to be fastened to the front plate, said holding member having a lateral flange;

a base member formed integrally from the single thickness of metal sheet material of the respective metal side frame at the front end thereof;

a supporting member having a portion with a U-shaped configuration when viewed from the top;

clamping screw means for connecting said supporting member to said base member;

said lateral flange of said holding member being insertable into said U-shaped configuration of said portion of said supporting member from the top thereof; and means for fixing the relative positions of said holding member and said supporting member.

2. A device as claimed in claim 1, wherein said fixing means comprises a resilient flap extending from said holding member and engaging in an opening in said supporting member and urging said holding member in a direction to bring said flange into engagement with said supporting member.

3. A device as claimed in claim 1, wherein said fixing means comprises an inclined surface of said base member engaged by a complementarily shaped inclined surface of said supporting member, such that upon tightening of said clamping screw means said supporting member is moved by said engaging inclined surfaces in a direction to bring said supporting member into engagement with said flange of said holding member.

4. A device as claimed in claim 1, wherein said base member is punched laterally from said metal side frame.

5. A device as claimed in claim 1, wherein said base member comprises a flange bent laterally from said front end of said metal side frame and extending in a direction to be parallel to the front plate.

6. A device as claimed in claim 1, further comprising means for adjusting the vertical position of said holding member relative to said supporting member.

7. A device as claimed in claim 6, wherein said adjusting means comprises an eccentric mounted on a lower portion of said metal side frame and abutting a lower portion of said holding member.

8. A device as claimed in claim 6, wherein said adjusting means comprises a flap extending from a lower portion of said supporting member, said flap having therethrough a threaded opening, and an adjustment screw threaded through said opening and abutting said holding member.

9. A device as claimed in claim 1, wherein said holding member has extending from the top thereof a flap abutted by and covering said supporting member.

10. A fastening device for connecting a front plate of a drawer to metal side frames of the drawer, each side frame being formed by a single thickness of metal sheet material, said fastening device comprising, for each side of the drawer:

a holding member to be fastened to the front plate;

a supporting member engageable with said holding member;

clamping screw means mounted on said supporting member;

a forwardly open angular slot formed in the front end of the respective metal side frame; and said clamping screw means being insertable into said slot, such that said supporting and holding members and the front plate are mounted on said front end of the metal side frame, whereupon said clamping screw means are tightened to fix the position of said supporting member relative to said metal side frame.

11. A device as claimed in claim 10, wherein said supporting member has therein at least one undercut recess, and said holding member has at least one projection shaped complementary to said recess and insertable therein.

12. A device as claimed in claim 11, wherein said recess and projection extend laterally, such that said holding member is laterally mountable on said supporting member.

13. A device as claimed in claim 11, further comprising eccentric means for fixing the relative position of said holding and supporting members.

14. A device as claimed in claim 10, wherein said supporting member has extending therefrom a pair of parallel flanges, said clamping screw means extends between said parallel flanges, and said front end of said metal side frame extends between said parallel flanges when said clamping screw means is inserted into said slot.

15. A device as claimed in claim 10, further comprising means for adjusting the vertical position of said holding and supporting members relative to said metal side frame, said adjusting means comprising an eccentric mounted on a lower portion of said metal side frame and abutting a lower portion of said supporting member.

* * * * *